US009560893B2

(12) United States Patent
Gleason et al.

(10) Patent No.: US 9,560,893 B2
(45) **Date of Patent: *Feb. 7, 2017**

(54) HEADGEAR WITH A SPRING BUFFERED OCCIPITAL CRADLE

(71) Applicant: Honeywell International, Inc., Morristown, NJ (US)

(72) Inventors: Wayne Gleason, West Greenwich, RI (US); Raymond Curci, Smithfield, RI (US); Brett Pulito, Blackstone, MA (US); Kevin Beckerdite, Brookfield, MA (US); Rita Fulton, Wrentham, MA (US)

(73) Assignee: HONEYWELL INTERNATIONAL, INC., Morristown, NJ (US)

( * ) Notice: Subject to any disclaimer, the term of this patent is extended or adjusted under 35 U.S.C. 154(b) by 212 days.

This patent is subject to a terminal disclaimer.

(21) Appl. No.: 14/488,582

(22) Filed: Sep. 17, 2014

(65) Prior Publication Data

US 2015/0000007 A1 Jan. 1, 2015

Related U.S. Application Data

(63) Continuation of application No. 13/113,294, filed on May 23, 2011, now Pat. No. 8,850,624.

(51) Int. Cl.

| | |
|---|---|
| ***A42B 3/08*** | (2006.01) |
| ***A42B 3/14*** | (2006.01) |
| ***A42B 3/04*** | (2006.01) |

(52) U.S. Cl.

CPC ..... *A42B 3/085* (2013.01); *A42B 3/0406* (2013.01); *A42B 3/142* (2013.01)

(58) Field of Classification Search

CPC ..... A42C 5/02; A42C 5/04; A42B 3/14; A42B 3/142; A42B 3/085; A42B 3/0406; A42B 3/145; A42B 3/04; A42B 1/22; A42B 1/08

USPC ..... 2/416, 420, 181, 182.1, 182.2, 182.6,2/182.7

See application file for complete search history.

(56) References Cited

U.S. PATENT DOCUMENTS

| | | | |
|---|---|---|---|
| 2,181,446 | A | 11/1939 | Ames |
| 2,769,176 | A | 11/1956 | Grancsay et al. |
| 3,852,821 | A | 12/1974 | Mickel |
| 4,884,301 | A | 12/1989 | Aileo |
| 4,942,628 | A | 7/1990 | Freund |
| 5,003,640 | A | 4/1991 | Pizzacar |
| 5,150,479 | A | 9/1992 | Oleson |
| 5,499,402 | A | 3/1996 | Rose |
| 5,517,691 | A | 5/1996 | Blake |
| 5,546,605 | A | 8/1996 | Mallardi |
| 5,638,551 | A | 6/1997 | Lallemand |

(Continued)

*Primary Examiner* — Gloria Hale

(74) *Attorney, Agent, or Firm* — Barlow, Josephs & Holmes, Ltd.

(57) ABSTRACT

A headgear for a head safety product such as a face shield, hardhat or welding helmet includes a spring buffered cradle mounted on the horizontal band of the headgear to improve the fit, function, stability and comfort of the headgear. The cradle is flexible and has a concave inner surface contoured to conform to the shape of the head. A spring element is coupled between the cradle and the horizontal band to buffer the tension between the band and the head and more equally distribute pressure across the head. In a preferred embodiment, an occipital cradle includes two leaf springs coupled to the rear portion of the horizontal band.

4 Claims, 12 Drawing Sheets

(56) References Cited

U.S. PATENT DOCUMENTS

| | | | | |
|---|---|---|---|---|
| 5,657,492 | A | 8/1997 | Esposito, Jr. | |
| 5,794,272 | A | 8/1998 | Workman et al. | |
| 5,898,950 | A | 5/1999 | Spyrou et al. | |
| 5,950,242 | A | 9/1999 | Mahoney | |
| 6,006,362 | A | 12/1999 | Walsh | |
| 6,279,172 | B1 * | 8/2001 | Epperson et al. | 2/410 |
| 6,332,227 | B1 * | 12/2001 | Fang | 2/418 |
| 6,367,085 | B1 * | 4/2002 | Berg | 2/202 |
| 6,401,261 | B1 | 6/2002 | Arney et al. | |
| 6,425,142 | B2 | 7/2002 | Sasaki et al. | |
| D503,499 | S | 3/2005 | Howard et al. | |
| 6,966,074 | B2 | 11/2005 | Huh | |
| 6,968,575 | B2 | 11/2005 | Durocher | |
| 7,007,306 | B2 | 3/2006 | Howard et al. | |
| 7,120,939 | B1 | 10/2006 | Howard et al. | |
| 7,441,282 | B2 | 10/2008 | Heine et al. | |
| 7,827,617 | B2 | 11/2010 | Trainor et al. | |
| 8,015,625 | B2 * | 9/2011 | Grim et al. | 2/420 |
| 2004/0255370 | A1 | 12/2004 | Moeller et al. | |
| 2005/0138719 | A1 * | 6/2005 | Huh | 2/416 |
| 2010/0229286 | A1 | 9/2010 | Ahlgren et al. | |

* cited by examiner

HEADGEAR WITH A SPRING BUFFERED OCCIPITAL CRADLE

CROSS-REFERENCE TO RELATED APPLICATIONS

This application is a continuation of pending U.S. application Ser. No. 13/113,294, filed May 23, 2011.

BACKGROUND

The present specification relates to a headgear or suspension of the type used in a head safety product such as a face shield, hardhat or welding helmet. More particularly, the specification is directed to a spring buffered occipital cradle mounted on the rear portion of the horizontal band of the headgear to improve the fit, function, stability and comfort of the headgear.

SUMMARY

An improved headgear includes a spring buffered cradle mounted on the horizontal band of the headgear to improve the fit, function, stability and comfort of the headgear. The cradle is flexible and has a concave inner surface contoured to conform to the shape of the head. A buffer spring is coupled between the cradle and the horizontal band to buffer or absorb the tension between the horizontal band and the head and more equally distribute pressure across the head. In a preferred embodiment, the cradle is located in the rear of the headgear to engage the occipital area of the head and includes two spaced leaf springs coupled to the rear portion of the horizontal band.

More specifically, the preferred embodiment of the headgear comprises a horizontal band encircling the head, an adjustment mechanism configured and arranged to adjust a circumference of the horizontal band, a vertical cross-band extending over the crown of the head, a flexible cradle having a generally concave inner surface contoured to conform to the occipital area of the head, and a pair of buffer springs coupled between the cradle and the horizontal band to buffer tension and absorb pressure between the horizontal band and the head.

The horizontal band preferably includes a front portion that extends across a forehead area and a rear portion that extends downwardly and rearwardly below an equatorial region of the head and across an occipital area of the head. The adjustment mechanism is centrally located on the rear portion of the horizontal band and is flanked on both sides by the opposed leaf springs. The first leaf spring is coupled between a left lobe of the cradle and the rear portion of the horizontal band to the left of the adjustment mechanism while the second lead spring is coupled between a right lobe of the cradle and the rear portion of the horizontal band to the right of the adjustment mechanism. The leaf springs are preferably, integrally formed with said cradle where the leaf springs each have a proximal first end integrally formed with the cradle and a distal second end formed in the shape of a loop that slidably encircles said horizontal band.

In use, the loops allow the cradle to slide relative to the horizontal band as well as to tilt slightly. This loose movement permits the cradle to follow the expansion and contraction of the horizontal band during adjustment and conform more readily to the shape of the head. Most important for commercialization of the idea, the loops make the cradle compatible with existing headgear having a horizontal band, whereby the cradle can be adaptively fit into existing headgear already deployed in the field.

Accordingly, an objective is to provide a headgear that improves fit, function, stability and comfort.

Another objective is to provide a cradle for a headgear that is flexible and self-adjusting.

Yet another objective is to provide a cradle that cups the head below the equatorial region to provide an improved fit.

Still another objective is to provide a spring buffer for the cradle that more equally distributes or buffers pressure between the horizontal band and the head.

Finally, it is yet another objective to provide a cradle which is readily adaptable to both new headgear and headgear already deployed in the field.

Other objects, features and advantages shall become apparent as the description thereof proceeds when considered in connection with the accompanying illustrative drawings.

BRIEF DESCRIPTION OF THE DRAWING FIGURES

A preferred embodiment will now be described further by way of example with reference to the following examples and figures, which are intended to be illustrative only and in no way limiting upon the scope of the disclosure.

DETAILED DESCRIPTION OF THE PREFERRED EMBODIMENT

Figure 1:
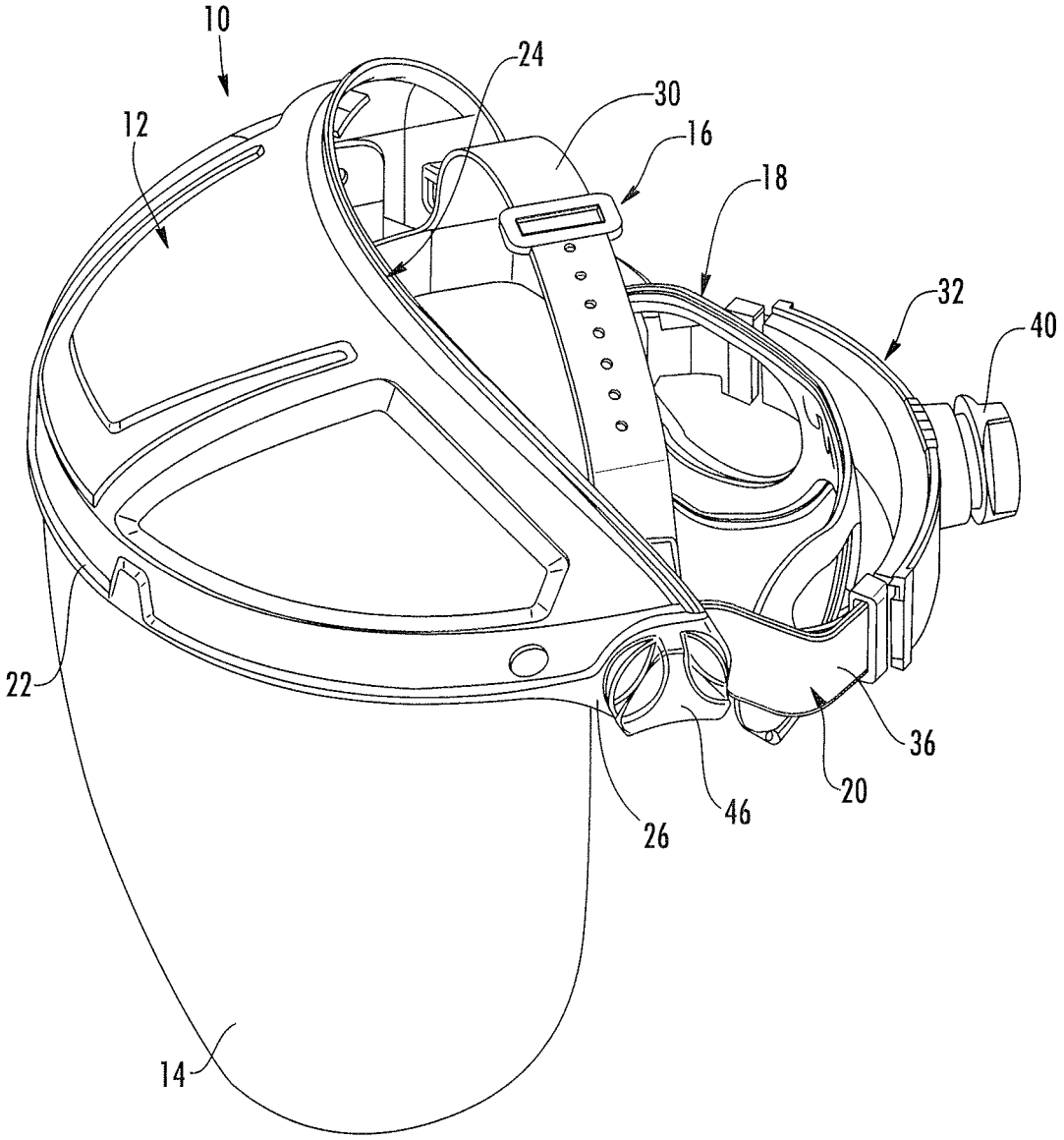
FIG. 1 is a perspective view of a face shield including the present headgear and cradle.

Generally, an improved headgear as illustrated and described herein includes a spring buffered cradle mounted on the horizontal band of the headgear to improve the fit, function, stability and comfort of the headgear. The cradle is flexible and has a concave inner surface contoured to conform to the shape of the head. A spring element is coupled between the cradle and the horizontal band to buffer the tension between the band and the head and more equally distribute pressure across the head. In a preferred embodiment as illustrated, the cradle is located in the rear of the headgear to engage the occipital area of the head and includes two leaf springs coupled to the rear portion of the horizontal band. However, other configurations of the headgear and cradle are also contemplated where a similar cradle could be located in the front of the headgear or on the top of the headgear, or even further, on multiple areas of the headgear.

Referring to FIGS. 1-5, the preferred embodiment of the headgear and cradle are embodied in a face shield product indicated at 10. While the preferred embodiment is illustrated in conjunction with a face shield product, it should also be understood that the present headgear and cradle are contemplated for use in other head safety products, including but not limited to hardhats and welding helmets.

The face shield 10 comprises a crown generally indicated at 12, a transparent lens generally indicated at 14 secured to the crown 12, a headgear generally indicated at 16 pivotably attached to the crown 14, and a spring buffered cradle generally indicated at 18 mounted on a horizontal band 20 of the headgear 16 to improve the fit, function, stability and comfort of the headgear 16.

The crown 12 is preferably a molded plastic component having an arcuate shape contoured to conform to the shape of the forehead. The crown 12 includes a forward edge 22 and a rearward edge 24 that meet at opposing sides to form opposing pivot tabs 26, 28.

The headgear components are preferably molded from a resilient plastic material and generally comprise the horizontal band 20 that encircles the head, a vertical cross-band 30 extending over the crown of the head, and a rack and pinion adjusting mechanism 32 for sizing the horizontal band 20 to a desired circumference and depth to achieve a desired fit on the user's head.

The horizontal band 20 includes a front portion 34 that extends across a forehead area and a rear portion 36 that extends downwardly and rearwardly below an equatorial region of the head and across an occipital area of the head. The front portion 34 of the band preferably includes a cushioned pad 38 extending across the brow area.

The adjustment mechanism 32 is centrally located on the rear portion 36 of the horizontal band 20 and has a well-known construction for sizing the horizontal band 20 to a desired circumference and depth. As is well known, opposing sides of the rear portion 36 of the horizontal band 20 overlap at the rear and are captured within the adjusting mechanism 32. Turning the adjustment knob 40 in one direction pulls the band ends closer while turning the knob 40 in the other direction forces them apart.

The vertical cross-band 30 also includes overlapping portions, which can be adjusted and secured for proper size and fit.

Figure 2:
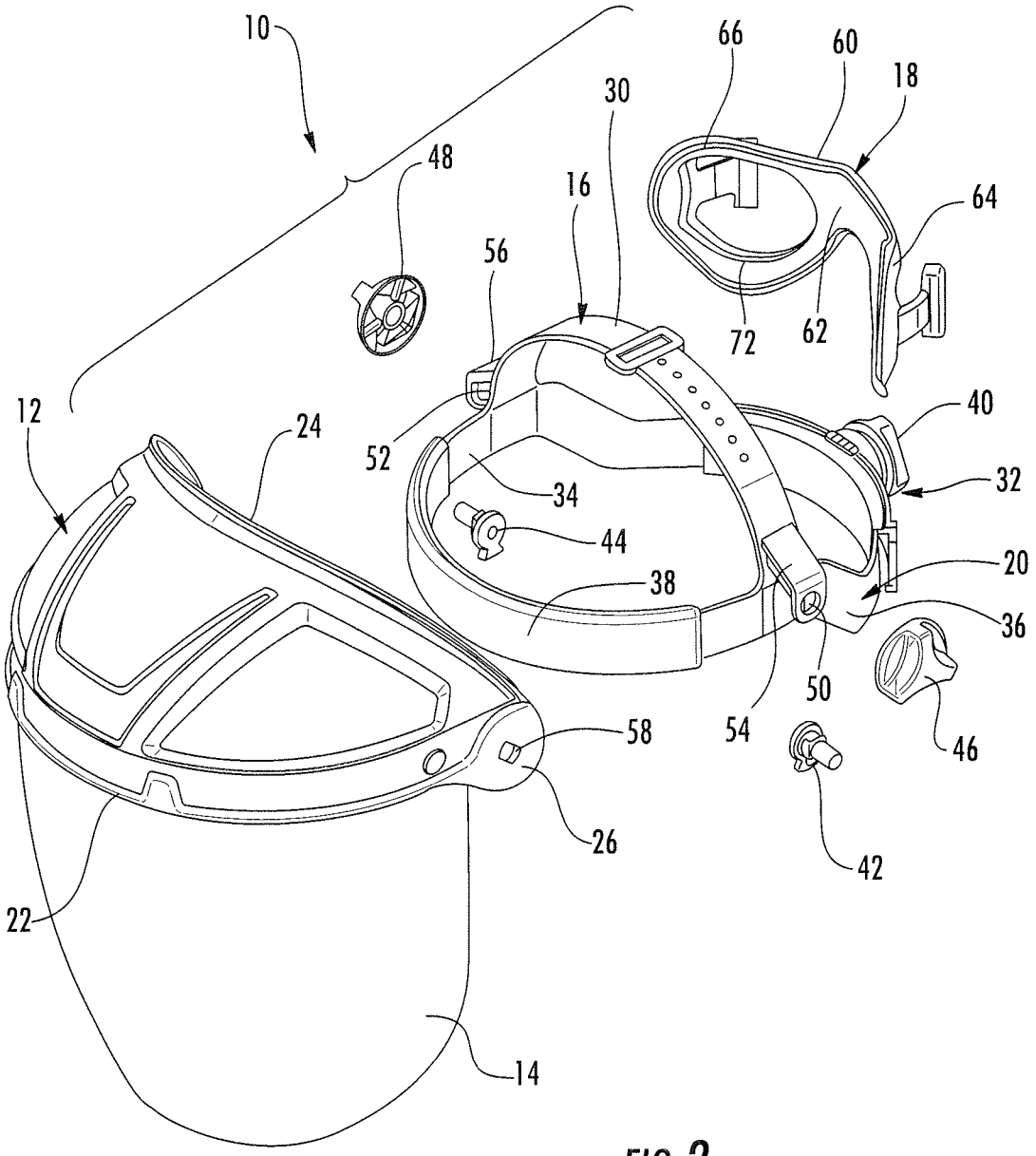
FIG. 2 is an exploded perspective view thereof.
Figure 3:
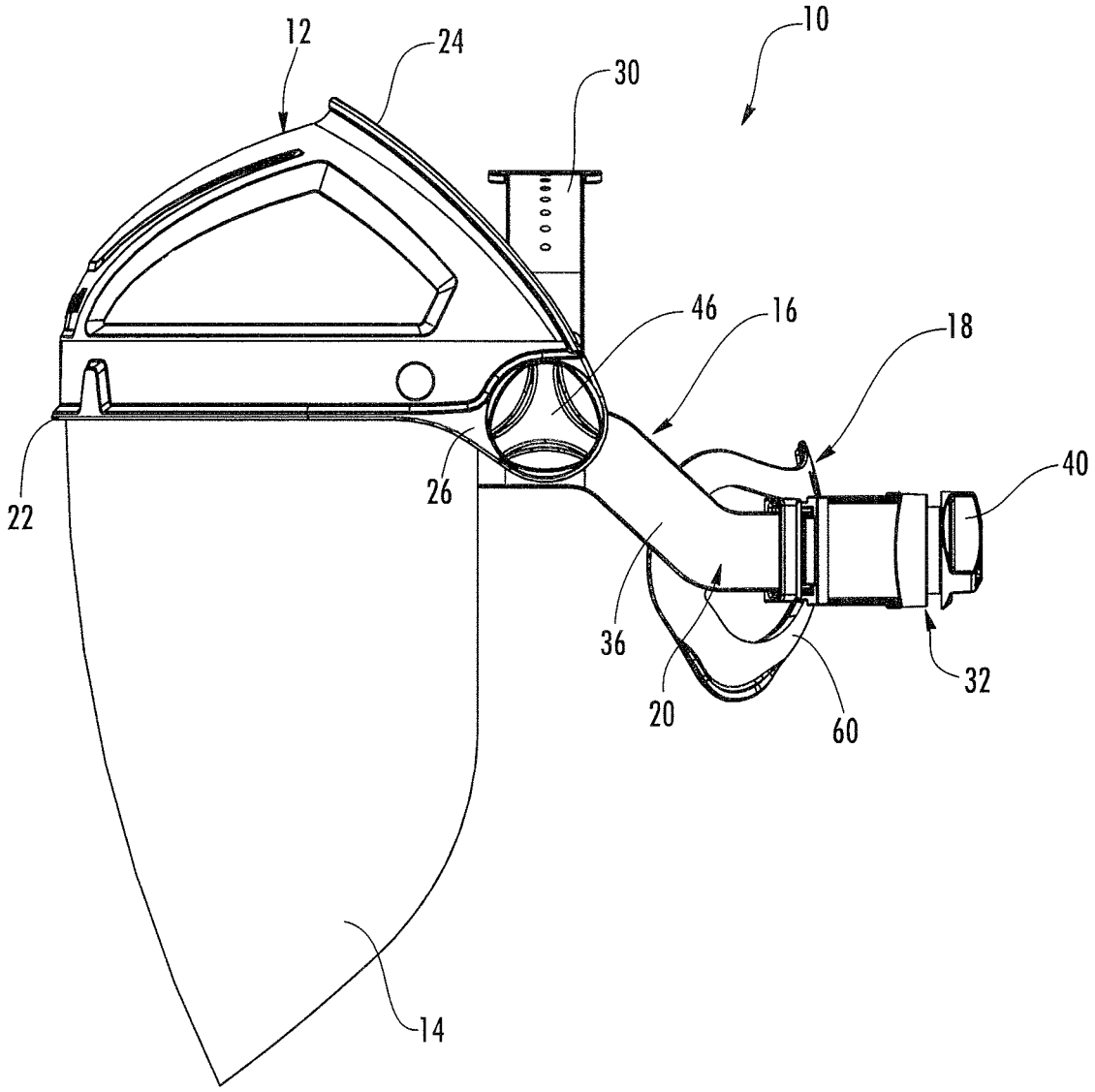
FIG. 3 is a right side view thereof.
Figure 4:
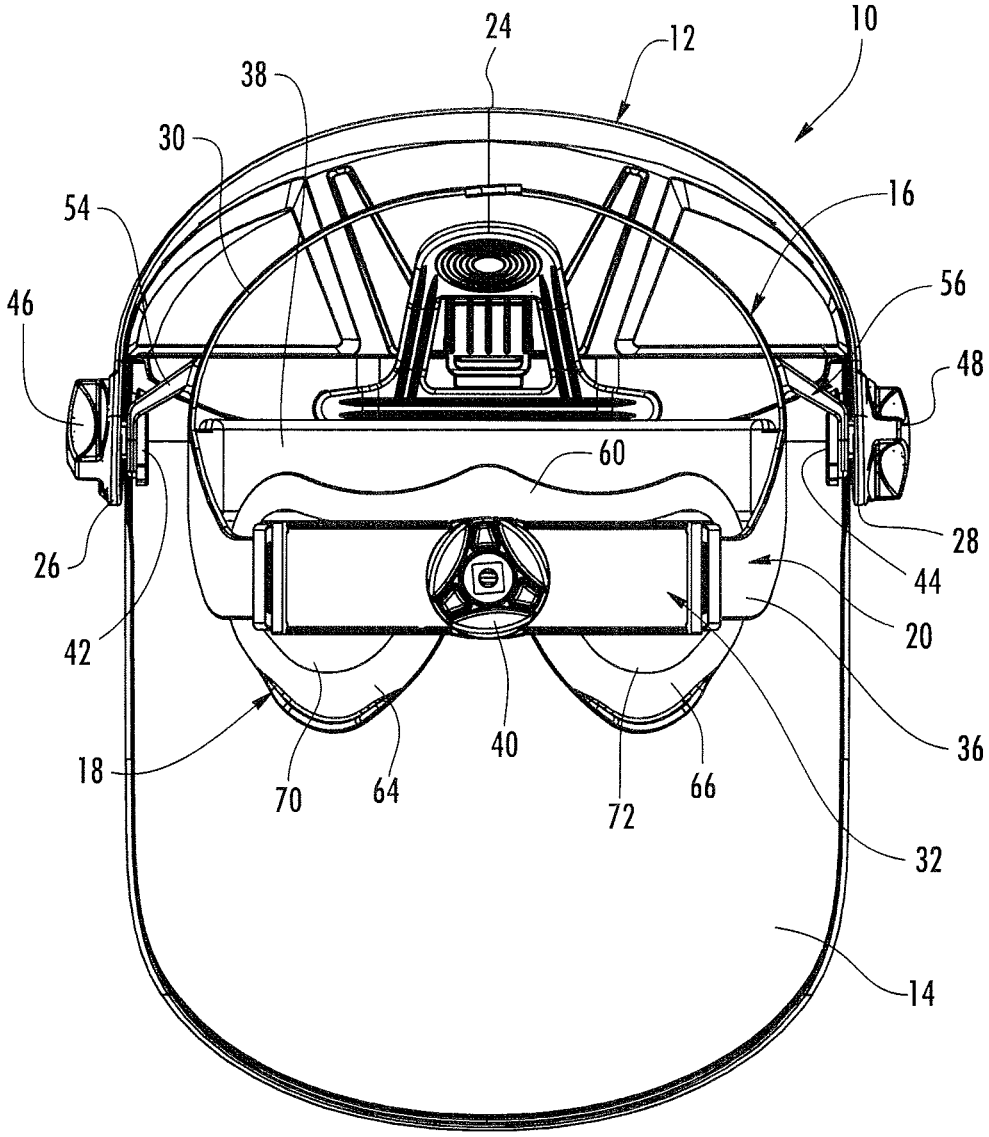
FIG. 4 is a rear view thereof.
Figure 5:
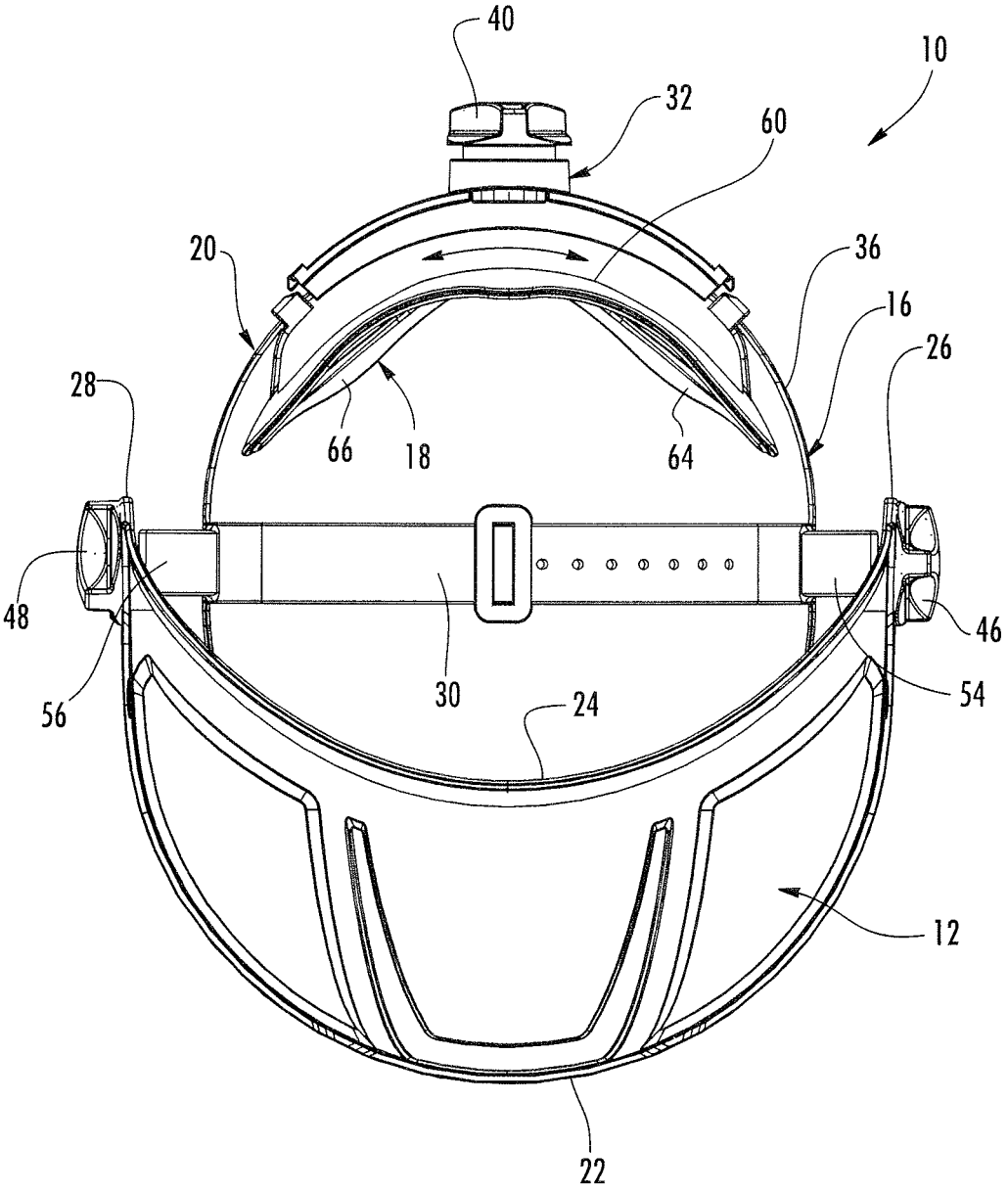
FIG. 5 is a top view thereof.

Referring to FIG. 2, the headgear 14 is pivotably mounted to the crown 12 by pivot assemblies positioned at opposing sides. The pivot assemblies each comprise a threaded pivot post 42, 44 and a threaded knob 46, 48 received onto the posts 42, 44. The threaded posts 42, 44 first pass through openings 50, 52 in downwardly extending leg 54, 56 of the vertical band 30 and then through aligned openings 58 (only one shown) in the pivot tabs 26, 28 of the crown 12. The threaded knobs 46, 48 received onto the ends of the posts 42, 44 to capture all of the components together. In use, the crown 12 and lens 14 are rotatable relative to the headgear 16 to swing the lens 14 upwardly out of the way when not needed.

Figure 8:
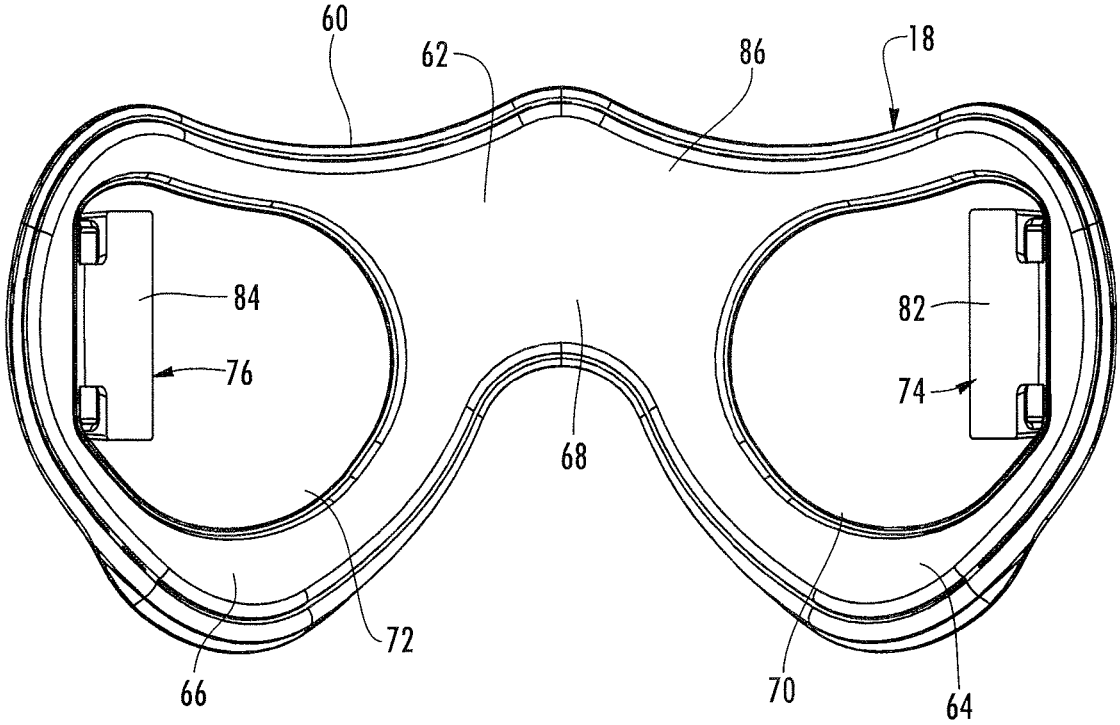
FIG. 8 is a front view thereof.
Figure 9:
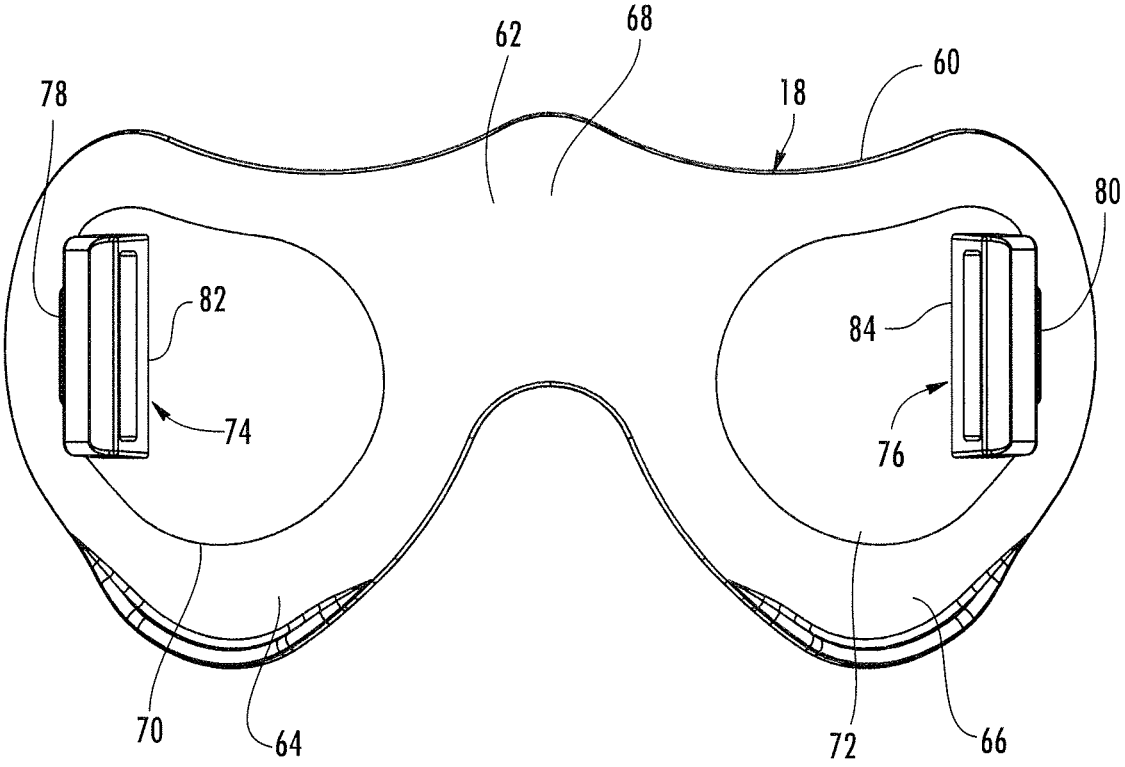
FIG. 9 is a rear view thereof.
Figure 10:
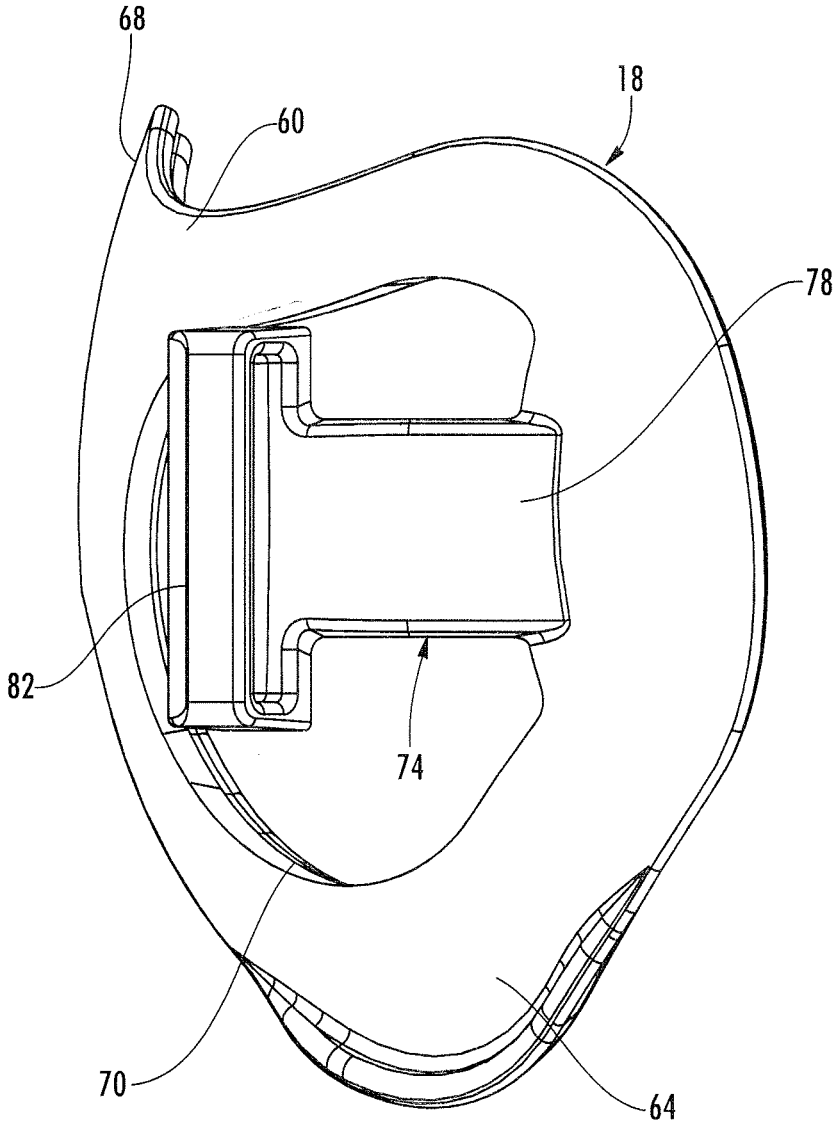
FIG. 10 is a left side view thereof.
Figure 11:
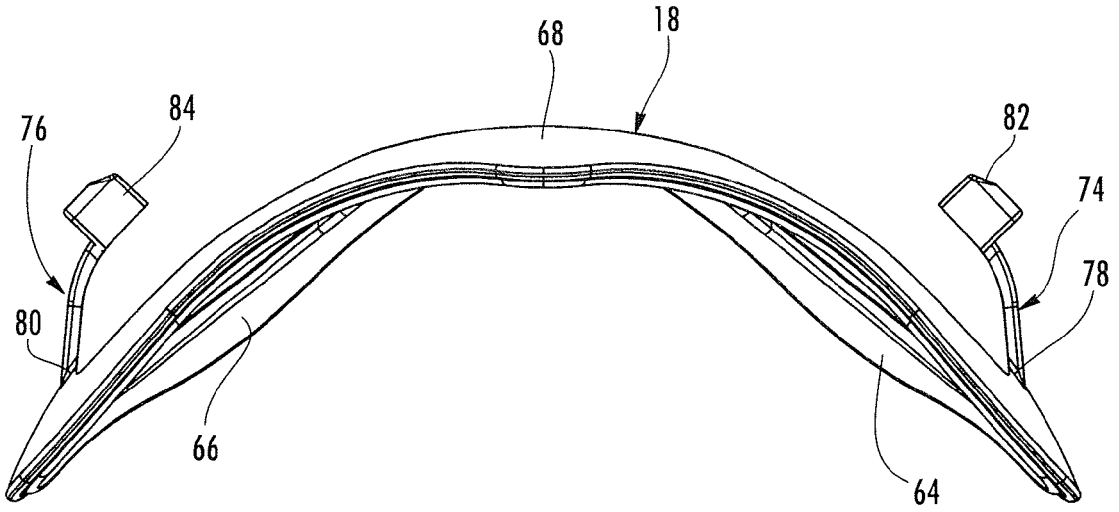
FIG. 11 is a top view thereof.
Figure 12:
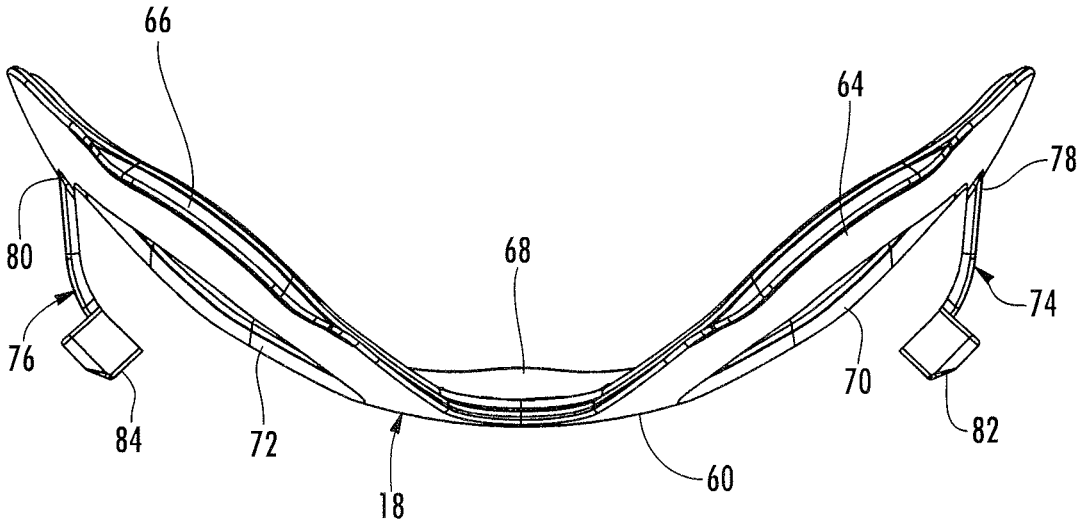
FIG. 12 is a bottom view thereof.

Referring 7-12, the cradle 18 has a flexible body 60 and a generally concave inner surface 62 contoured to conform to the occipital area of the head. Turning to FIG. 8 it can be seen that the body 18 has symmetrical right and left lobes 64, 66 extending from a central web 68. Each of the lobes 64, 68 is formed as a frame with a central opening 70, 72 to enhance flexibility of the cradle 18. As indicated hereinabove, it is contemplated that the cradle 18 could also be mounted in alternative locations within the headgear 16, and in this regard, the cradle shape and contour would be adapted to conform to the particular shape of the head to be engaged. Specifically, the cradle 18 could be adapted to be mounted on the front portion of the horizontal band extending across the forehead, and could also be adapted to be mounted on the vertical cross-band extending over the crown of the head.

Figure 6:
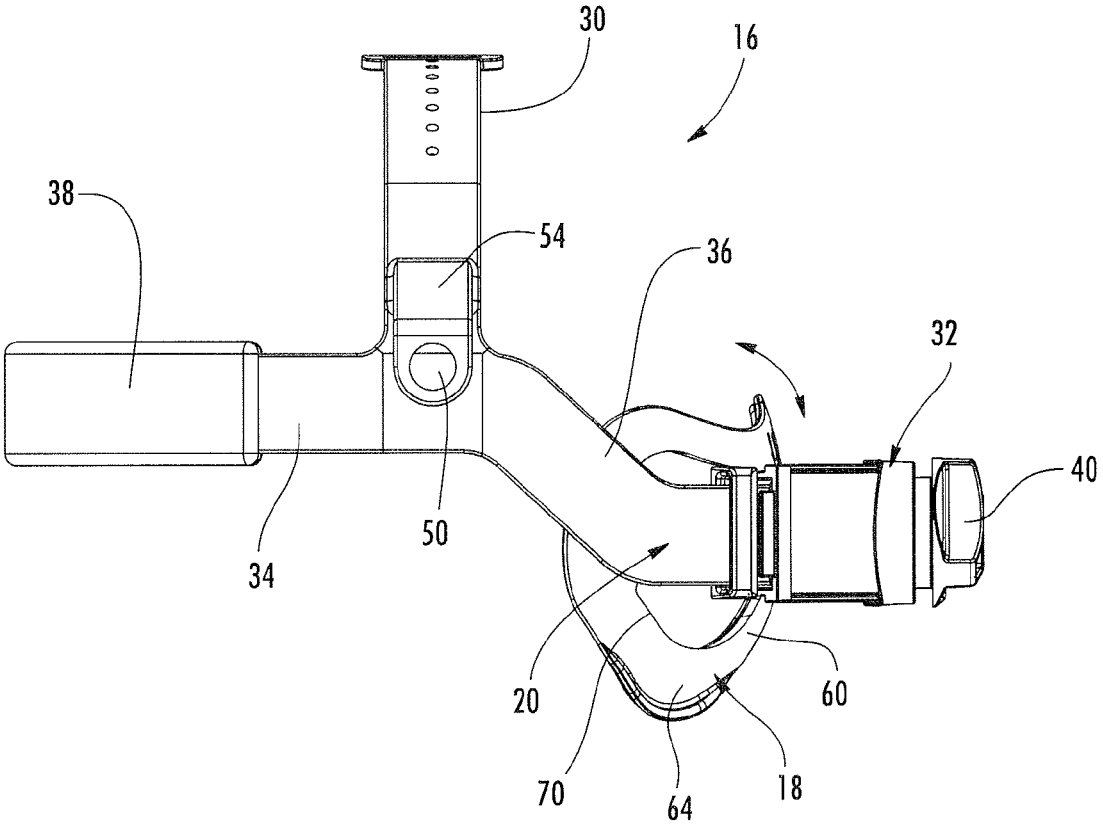
FIG. 6 is a right side view of the present headgear and cradle.
Figure 7:
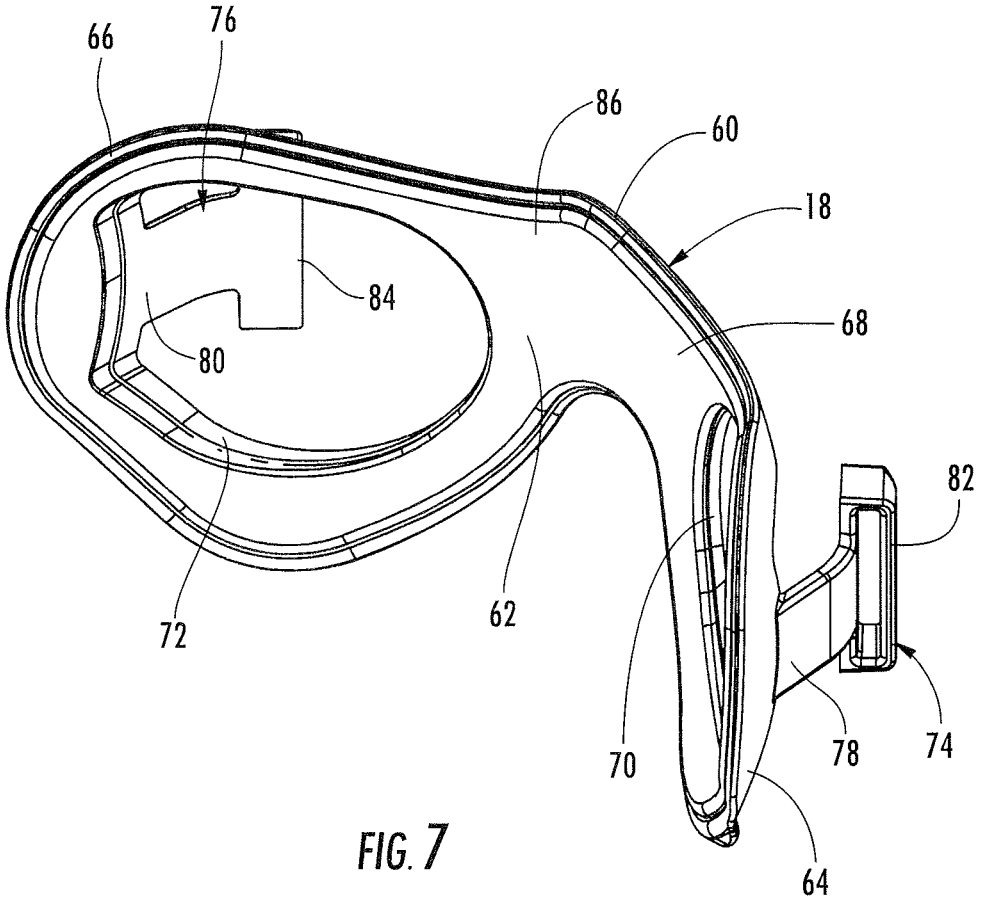
FIG. 7 is a perspective view of the present cradle.

Still referring to FIGS. 7-12, an opposed pair of leaf springs 74, 76 are coupled between the cradle 18 and the horizontal band 20 to buffer tension and pressure between the horizontal band 20 and the head. The first leaf spring 74 is coupled between a right lobe 64 of the cradle 18 and the rear portion 36 of the horizontal band 20 to the right of the adjustment mechanism 32 while the second leaf spring 76 is coupled between the left lobe 66 of the cradle 18 and the rear portion 36 of the horizontal band 20 to the left of the adjustment mechanism 32 (see FIGS. 4 and 5). The leaf springs 74, 76 are preferably, integrally formed with the cradle 18 where the leaf springs 74, 76 each have a proximal first end 78, 80 integrally formed with the cradle 18 and a distal second end 82, 84 formed in the shape of a loop that slidably encircles the horizontal band 20. The distal loop ends 82, 84 allow the cradle 18 to slide relative to the horizontal band 20 (see arrows in FIG. 5), as well as tilt slightly (See arrows in FIG. 6). This loose movement permits the cradle 18 to follow the expansion and contraction of the horizontal band 20 during adjustment and conform more readily to the shape of the head. Furthermore, the distal end loops 82, 84 are compatible with most existing headgear so that the cradle 18 can be adaptively installed into existing headgear already deployed in the field.

While the spring elements of the preferred embodiment are configured as leaf springs 74, 76, this should not be limiting as it is contemplated within the scope of the disclosure that other configurations of springs could be equally effective in providing a buffer between the cradle 18 and the band 20.

The inner surface 62 of the cradle 18 is provided with a cushioned pad 86 that further improves the fit of the cradle 18. Preferably, the cushioned pad 86 is molded onto the surface of the cradle 18 in a two-shot injection molding process, which is known in the art.

In summary, it can be appreciated from the foregoing description and illustrations that the shape and position of the cradle 18 is such that it gently cups the head below the equatorial region of the head and gently grips around the mastoid bone area (occipital area) creating a more secure fit with far less clamping force. The cradle configuration is completely passive and requires no additional effort by the end user to use or adjust. The adjustment mechanism 32 is the same as currently known by the user and thus requires no additional training. In use, the cradle 18 follows the expansion and contraction of the horizontal band 20 and automatically adjusts to the size accordingly. The cradle 18 is self-adjusting and aligning allowing it to gently conform in shape to the user's head and seat itself in a manner that equally distributes contact and pressure on the rear of the user's head. In this regard, the leaf springs 74, 76 are a critical aspect of cradle 18 in buffering the tension on the horizontal band 20 and absorbing impact to the supported safety product. As the band 20 is tightened the leaf springs 74, 76 flex to more equally distribute any pressure as opposed to localizing any pressure. Because the cradle works in a cupping manner securely below the equatorial region of the head, it provides a secure fit and feeling with far less tension and pressure that a standard headgear arrangement. The spring and flex of the leaf springs 74, 76 further allows the user to don and doff the headgear easily without loosening and tightening the headgear 16 each time.

Accordingly, among the objectives of the improved headgear 16 are to provide a headgear that improves fit, function, stability and comfort, to provide a cradle 18 for a headgear that is flexible and self-adjusting, to provide a cradle that cups the head below the equatorial region to provide an improved fit, to provide a spring buffer for the cradle that more equally distributes or buffers pressure between the horizontal band and the head, and to provide a cradle which is readily adaptable to both new headgear and headgear already deployed in the field.

For these reasons, the present headgear and cradle are believed to represent significant advancements in the art, which have substantial commercial merit.

While there is shown and described herein certain specific structure embodying the headgear and cradle, it will be manifest to those skilled in the art that various modifications and rearrangements of the parts may be made without departing from the spirit and scope of the underlying concept and that the same is not limited to the particular forms herein shown and described except insofar as indicated by the scope of the appended claim.

What is claimed is:

1. A headgear comprising:

a horizontal band configured to encircle a user's head, said horizontal band including a front portion configured to extend across a forehead area of the user and a rear portion configured to extend across an occipital area of the head of the user;

an adjustment mechanism configured and arranged to adjust a circumference of the horizontal band; and an integrally formed flexible cradle having a left lobe and a right lobe which are connected by a central web, said flexible cradle including a first buffer spring coupled between said left lobe of said cradle and said rear portion of said horizontal band, and a second buffer spring coupled between said right lobe of said cradle and said rear portion of said horizontal band, said first and second buffer springs cooperating with said flexible cradle to buffer tension between said horizontal band and said head, said first and second buffer springs each comprising a leaf spring having a first end coupled to an end portion of a respective lobe and a second mounting end extending rearwardly and inwardly back toward said central web where said second mounting end is coupled to said horizontal band, said second mounting end comprising a vertically extending loop that loosely encircles said horizontal band whereby said cradle is slidably movable and tilts relative to said horizontal band, whereby each of said leaf springs is configured to spring-bias the respective mounting end away from said flexible cradle.

2. The headgear of claim 1 wherein said flexible cradle includes a compressible pad on said inner surfaces of said lobes.

3. A flexible cradle for use with a headgear having a horizontal band configured for encircling a user's head, said cradle comprising a left lobe and a right lobe which are integrally formed with and connected by a central web, said cradle including a first buffer spring coupled between said left lobe of said cradle and said rear portion of said horizontal band, and a second buffer spring coupled between said right lobe of said cradle and said rear portion of said horizontal band, said first and second buffer springs cooperating with said flexible cradle to buffer tension between said horizontal band and said head, said first and second buffer springs each comprising a leaf spring having a first end coupled to an end portion of a respective lobe and a second mounting end extending rearwardly and inwardly back toward said central web where said second mounting end is coupled to said horizontal band, said second mounting end comprising a vertically extending loop that loosely encircles said horizontal band whereby said cradle is slidably movable and tilts relative to said horizontal band, whereby each of said leaf springs is configured to spring-bias the respective mounting end away from said flexible cradle.

4. The cradle of claim 3 further comprising a compressible pad on said inner surfaces of said lobes.

* * * * *